United States Patent [19]

Dejonc

[11] 4,159,511

[45] Jun. 26, 1979

[54] SHADOWLESS LIGHTING APPLIANCE FOR SURGICAL OPERATING THEATRES AND THE LIKE

[75] Inventor: Pierre Dejonc, Saint Maur, France

[73] Assignee: Societe Parisienne des Anciens Etablissements Bariber, Benard & Turenne, Paris, France

[21] Appl. No.: 856,457

[22] Filed: Nov. 30, 1977

[30] Foreign Application Priority Data

Nov. 30, 1976 [FR] France ..... 76 36089

[51] Int. Cl.[2] ..... F21V 7/00

[52] U.S. Cl. ..... 362/299; 362/309; 362/336; 362/804

[58] Field of Search ..... 362/299, 309, 336, 337, 362/346, 804

[56] References Cited

U.S. PATENT DOCUMENTS

| | | | |
|---|---|---|---|
| 389,878 | 9/1888 | Duhring | 362/336 |
| 1,597,185 | 8/1926 | Dorey | 362/336 X |
| 1,642,339 | 9/1927 | Kast | 362/336 X |
| 1,990,390 | 2/1935 | Rudy, Jr. | 362/337 |
| 3,928,757 | 12/1975 | Nelson | 362/804 X |
| 4,037,096 | 7/1977 | Brendgord et al. | 362/294 |

FOREIGN PATENT DOCUMENTS

| | | | |
|---|---|---|---|
| 1622028 | 10/1970 | Fed. Rep. of Germany | 362/336 |
| 2451926 | 5/1975 | Fed. Rep. of Germany | 362/336 |
| 375943 | 7/1932 | United Kingdom | 362/346 |

*Primary Examiner*—Peter A. Nelson
*Attorney, Agent, or Firm*—Karl W. Flocks

[57] ABSTRACT

The invention relates to a shadowless lighting appliance more particularly applicable for illuminating areas exposed for surgery in operating theatres. A lighting appliance according to this invention is characterized by the fact that it includes at least the following combination of means: - a light source; - a reflecting surface of revolution and - a glass formed of dioptric radial elements, the function of each element being to provide, by refraction to either side of a radial plane, the spreading of a beam of light reflected by a portion of said reflecting surface proximate a generatrix thereof, such that the elemental patch of light obtained on a plane be a luminous quadrilateral. In one form of embodiment, the above combination of means further includes a sleeve consisting of an optical system surrounding the light source.

10 Claims, 5 Drawing Figures

SHADOWLESS LIGHTING APPLIANCE FOR SURGICAL OPERATING THEATRES AND THE LIKE

The present invention relates to a shadowless lighting appliance more particularly applicable for illuminating areas exposed for surgery in operating theatres.

A lighting appliance according to this invention is characterized by the fact that it includes at least the following combination of means:

a light source;

a reflecting surface of revolution and a glass formed of dioptric radial elements, the function of each element being to provide, by refraction to either side of a radial plane, the spreading of a beam of light reflected by a portion of said reflecting surface proximate a generatrix thereof, such that the elemental patch of light obtained on a plane be a luminous quadrilateral.

In one form of embodiment, the above combination of means further includes a sleeve consisting of an optical system surrounding the light source.

The description which follows with reference to the accompanying non-limitative exemplary drawings will give a clear understanding of how the invention can be carried into practice.

Figure 1:
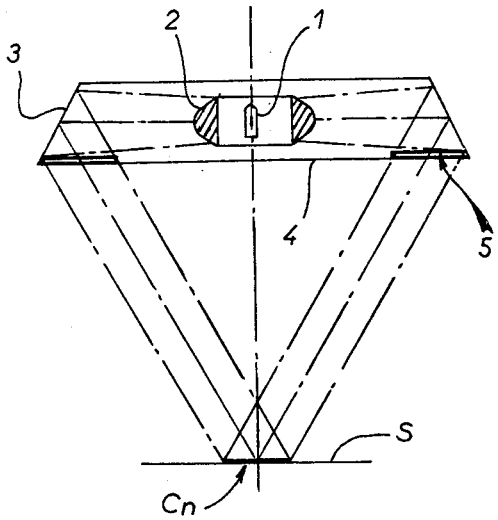
FIG. 1 is a sectional side elevation view of an appliance according to the invention.
Figure 2:
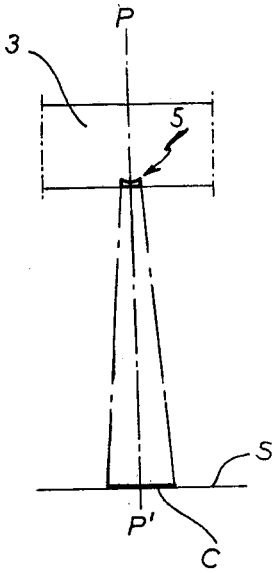
FIG. 2 is a fragmental diagrammatic representation of the spreading of a beam of light by a radial fluting.

Reference is first had to FIGS. 1 and 2 for a showing of a form of embodiment of a shadowless lighting appliance according to this invention which includes a light source 1, an optical sleeve 2 surrounding the light source, a frusto-conical reflecting surface of revolution 3 and a glass 4 having n dioptric radial elements which are in effect dioptric radial flutings 5. By a process of refraction to either side of a particular radial plane P–P', each fluting causes the spreading of a beam of light which it receives from a portion of the reflecting surface 3 proximate a generatrix thereof. Each fluting produces, upon a surface S, an elemental patch of light formed by a luminous quadrilateral and more particularly by a luminous square C. The plurality of squares $C_n$ produced thus by the n flutings are superimposed upon one another on the surface S.

Figure 3:
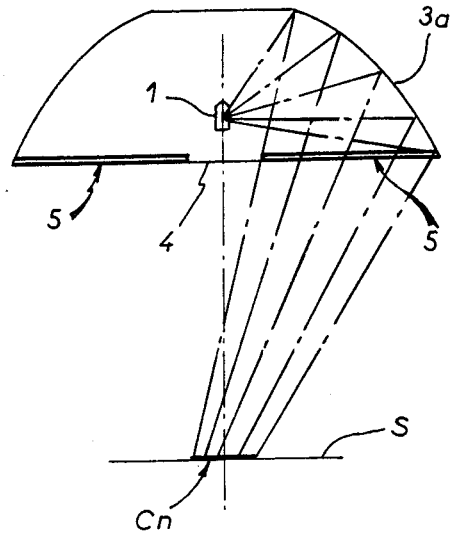
FIG. 3 is a sectional illustration in side elevation of an appliance according to the invention.

In the alternative embodiment illustrated in FIG. 3, the shadowless appliance according to this invention is devoid of an optical sleeve. The generatrix of the reflecting surface of revolution 3*a* has a curvature such that it replaces the convergence provided by the sleeve.

Figure 4:
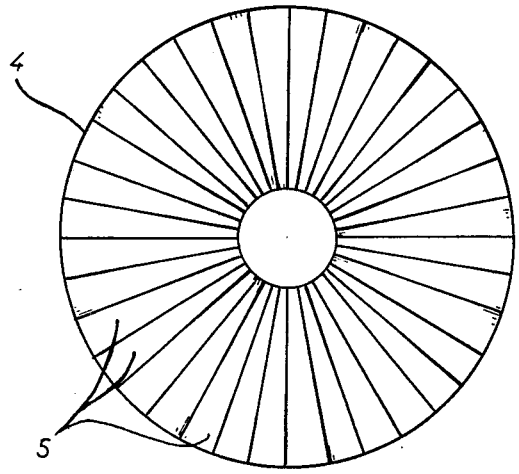
FIG. 4 is a plan view of a glass with radial dioptric flutings according to the invention.
Figure 5:
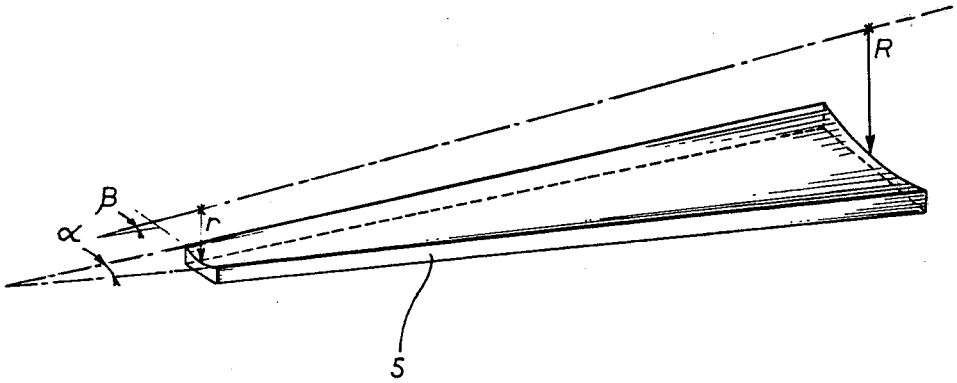
FIG. 5 is a perspective illustration, on an enlarged scale, of a dioptric radial fluting according to the invention.

The n dioptric radial flutings 5 in the glass 4 of an appliance according to the invention emerge more clearly in the plan view in FIG. 4 in the accompanying drawings. Each fluting 5 in the glass (FIG. 5) is included between two planes forming an angle $\alpha$, and each fluting covers the total field.

By virtue of the glacial geometric definition of each fluting, the width thereof goes increasing from the centre to the edge of the glass and, in order to obtain an identical spreading of the light beam from one end to the other of the fluting, the interior surface thereof is curved (concave or possibly convex) and has a continuously varying radius of curvature. The optimum of such interior surface is therefore a cone frustum of apex angle $\alpha$ having end radii of curvature R and r which are determined according to the refraction index of the material, the number n of flutings of angle $\alpha$, and the size of the elemental patches of light to be obtained.

It goes without saying that changes and substitutions of parts may be made in the exemplary embodiments hereinbefore described without departing from the scope of the invention as set forth in the appended claims.

I claim:

1. A shadowless lighting appliance comprising:

an operating plane, a light source means, a concave reflecting surface of revolution, glass formed of dioptric elements in a radial plane patterned around said outer edge, each of said elements being of a length shorter than the radius of said radial plane and providing by refraction to either side of said radial plane a spreading of a beam of light reflected by a portion of said concave reflecting surface, and an elemental patch of light in the form of a luminous quadrilateral on said operating plane.

2. A lighting appliance as claimed in claim 1, wherein each dioptric element is a fluting included between two planes forming an angle therebetween.

3. A lighting appliance as claimed in claim 1, wherein each dioptric element is a fluting included between two planes forming an angle therebetween, each fluting having a width which varies from the centre to the edge of the glass and the interior surface of each fluting being curved and having a continuously variable radius of curvature, said spreading of the beam of light from one end to the other of the fluting being identical.

4. A lighting appliance as claimed in claim 1, wherein each dioptric element is a fluting included between two planes forming an angle therebetween, each fluting having a width which varies from the centre to the edge of the glass and the interior surface of each fluting being concave and having a continuously variable radius of curvature, said spreading of the beam of light from one end to the other of the fluting being identical.

5. A lighting appliance as claimed in claim 1, wherein each dioptric element is a fluting included between two planes forming an angle therebetween, each fluting having a width which varies from the centre to the edge of the glass and the interior surface of each fluting being convex and having a continuously variable radius of curvature, said spreading of the beam of light from one end to the other of the fluting being identical.

6. A shadowless lighting appliance comprising:

an operating plane, a light source means, a sleeve consisting of an optical system placed around said light source means, a conical reflecting surface of a revolution, glass formed of dioptric elements in a radial plane patterned around said outer edge, each of said elements being of a length shorter than the radius of said radial plane and providing by refraction to either side of said radial plane a spreading of a beam of light reflected by a portion of said conical reflecting surface, and an elemental patch of light in the form of a luminous quadrilateral on said operating plane.

7. A lighting appliance as claimed in claim 6, wherein each dioptric element is a fluting included between two planes forming an angle therebetween.

8. A lighting appliance as claimed in claim 6, wherein each dioptric element is a fluting included between two planes forming an angle therebetween, each fluting having a width which varies from the centre to the edge of the glass and the interior surface of each fluting being curved and having a continuously variable radius of curvature, said spreading of the beam of light from one end to the other of the fluting being identical.

9. A lighting appliance as claimed in claim 6, wherein each dioptric element is a fluting included between two planes forming an angle therebetween, each fluting having a width which varies from the centre to the edge of the glass and the interior surface of each fluting being concave and having a continuously variable radius of curvature, said spreading of the beam of light from one end to the other of the fluting being identical.

10. A lighting appliance as claimed in claim 6, wherein each dioptric element is a fluting included between two planes forming an angle therebetween, each fluting having a width which varies from the centre to the edge of the glass and the interior surface of each fluting being convex and having a continuously variable radius of curvature, said spreading of the beam of light from one end to the other of the fluting being identical.

* * * * *